US007694898B2

(12) United States Patent
Munoz Huerta et al.

(10) Patent No.: US 7,694,898 B2
(45) Date of Patent: Apr. 13, 2010

(54) WATER-SAVING SHOWER HEAD WHICH OPERATES AT LOW AND HIGH PRESSURE

(76) Inventors: Ruben Arturo Munoz Huerta, Circuito Atlas Colomos, No. 3000-49, Col. Lomas del Bosque, Zapopan, Jalisco (MX) 45118; Juan Carlos Vizcaino Cervantes, Circuito Atlas Colomos, No. 3000-49, Col. Lomas del Bosque, Zapopan, Jalisco (MX) 45118; Arturo Barrera Echauri, Alambiques No. 2929. Col. Alamo Parquo Industrial, C.P., Tlaquepaque, Jalisco (MX) 45560

( * ) Notice: Subject to any disclaimer, the term of this patent is extended or adjusted under 35 U.S.C. 154(b) by 728 days.

(21) Appl. No.: 10/586,219

(22) PCT Filed: Jan. 16, 2004

(86) PCT No.: PCT/MX2004/000002

§ 371 (c)(1),
(2), (4) Date: Jul. 17, 2006

(87) PCT Pub. No.: WO2005/068083

PCT Pub. Date: Jul. 28, 2005

(65) Prior Publication Data

US 2008/0035760 A1 Feb. 14, 2008

(51) Int. Cl.
*B05B 15/08* (2006.01)

(52) U.S. Cl. ..... 239/587.4; 239/525; 239/556; 239/558; 239/590; 239/590.3

(58) Field of Classification Search ..... 239/101, 239/462, 463, 525, 530, 552, 556, 558, 590, 239/590.3, 590.5, 587.1, 587.4
See application file for complete search history.

(56) References Cited

U.S. PATENT DOCUMENTS 2,044,445 A * 6/1936 Price et al. ..... 239/587.4
6,343,750 B1 * 2/2002 Engel ..... 239/463
6,631,859 B2 * 10/2003 Schmidt ..... 239/587.4

* cited by examiner

*Primary Examiner*—Steven J Ganey
(74) *Attorney, Agent, or Firm*—James E. Walton

(57) ABSTRACT

The invention relates to a water-saving shower head which operates at low and high pressure. The inventive shower head comprises a knuckle consisting of an internally-threaded tubular section which is used to connect same to the tube, said tubular section being connected to a solid sphere containing an upper chamber therein. In turn, the upper chamber comprises a small funnel having three other small longitudinal, concentric and radially-equidistant conduits which are used to regulate the water flow and which flow into a conical cavity. The invention also comprises: a conoidal body containing an intermediate chamber which, in turn, comprises a solid cylinder with an upper conical cavity and four longitudinal, concentric and radially-equidistant conduits; and an inner conical surface of the ring forming the lower chamber which conditions the flow of water for the release thereof through the propulsion system formed by a smooth ring containing a series of four slightly-conical, toothed rings of different diameters, such as to form 52 rectangular, radially-arranged and equidistant conduits which propel the water outwards with sufficient force and density, thereby forming an adequate spray angle in order to produce a spray area that is comfortable for showering.

7 Claims, 5 Drawing Sheets

WATER-SAVING SHOWER HEAD WHICH OPERATES AT LOW AND HIGH PRESSURE

TECHNICAL FIELD OF THE INVENTION

This invention has an action within the mechanical area as well as environmental and hygienic due to the fact that its development incorporates technical characteristics that allow this device to work at low and high pressure and a considerable saving of water without losing the pleasing comfort of a shower.

INVENTION BACKGROUND

Water scarcity is a daily topic in the news. It is indispensable for all aspects of life. In international organisms (UN, Kyoto, Japan March 22 March 2003) The topic came to a consensus and it was concluded that water scarcity is something that will accentuate in a few years and it will cause multiple problems amongst humanity.

Many campaigns, trying to make people aware of how important water-saving is, have been spread in Mexico during the past few years despite this little has been achieved.

Many different technologies have been generated in trying to optimize the use if water, but those who have started these programs ended up giving up, some reasons are the small appearance of such devices or by the lose of the normal water pressure when using such devices, which is a main characteristic in our country due to the fact that in most homes the only pressure available is by gravity since big water containers-deposits are located on the roofs and the water flows down to either the bathroom, another reason for low pressure is mineral build up in the piping thus clogging them up easily in turn making them difficult to clean up (unclog). This is why a small minority use hydroneumatic systems to increase water pressure, so when using their shower is not an inconvenience for the people but the water consumption increases dramatically.

In application of utility model MX000712 a water-saving shower head is described, which is characterized by being mainly integrated by a bulb of water distribution chamber that spreads the water flow in a in a propelling form and is joint to an oscillating socket joint that allows it to vary its angle of inclination in reference to the water supply pipe. There is a reference of a water saving system in shower heads in patent MX152549 which is the combination of a funnel and hooks connected to the shower head, in addition to a storage tank located on the wall that distributes the water through an udder regulated by the water faucet located in the inside.

Utility model MX000564 refers to a high efficiency shower head at low pressure that is composed of a reducer connected to the house piping, which is also connected to a water feeding pipe on one end and to an obtruding device triggered by a lever on the other end and the body is incorporated through a thread in the knuckle, for movement it uses a rounded joint that is internally included in the thread that is connected to the chamber, characterized by conical body containing a series of 28, 48 or 71 a plate of radially-equidistant conduits, with an effect of low pressure efficiency that takes advantage of the minimum water flow transforming it in a ray of water, dense enough to provide the user comfort when taking a shower.

On the other hand patent MX 183485 describes flow distributor for shower heads that is composed of a plate with holes, a knuckle, a tubular element and it is characterized because the concentric tubular element is connected to the shower head body in such a longitude that it is located in the holed-plate of the shower head and in the coupling of the water supply of the shower head, this tubular portholes that establish the radial water flow.

In reference to what has been mentioned, with the intention of finding an alternative to avoid the waste of water when showering, we, the applicants, of this register, have created a shower head with this purpose (economize water), We have achieved designing this device with our own new technical characteristics, that reduces the consumption of water by no less than 5 litters per minute, without sacrificing comfort, which used to be offered only by a high consumption of water.

DETAILED DESCRIPTION OF THE INVENTION

The detailed characteristics of this water-saving shower heat which operates at a low and high pressure are clearly shown in the following description and the figures, submitted along this document, which are mentioned as examples and should not be considered limiting.

In reference to such figures, the water-saving shower head that operates under low and high pressure is formed primarily by a ball and socket joint, a conoid body, a ring and an impulse system which when are joined, internally contain three innovated chambers of water distribution.

Figure 1:
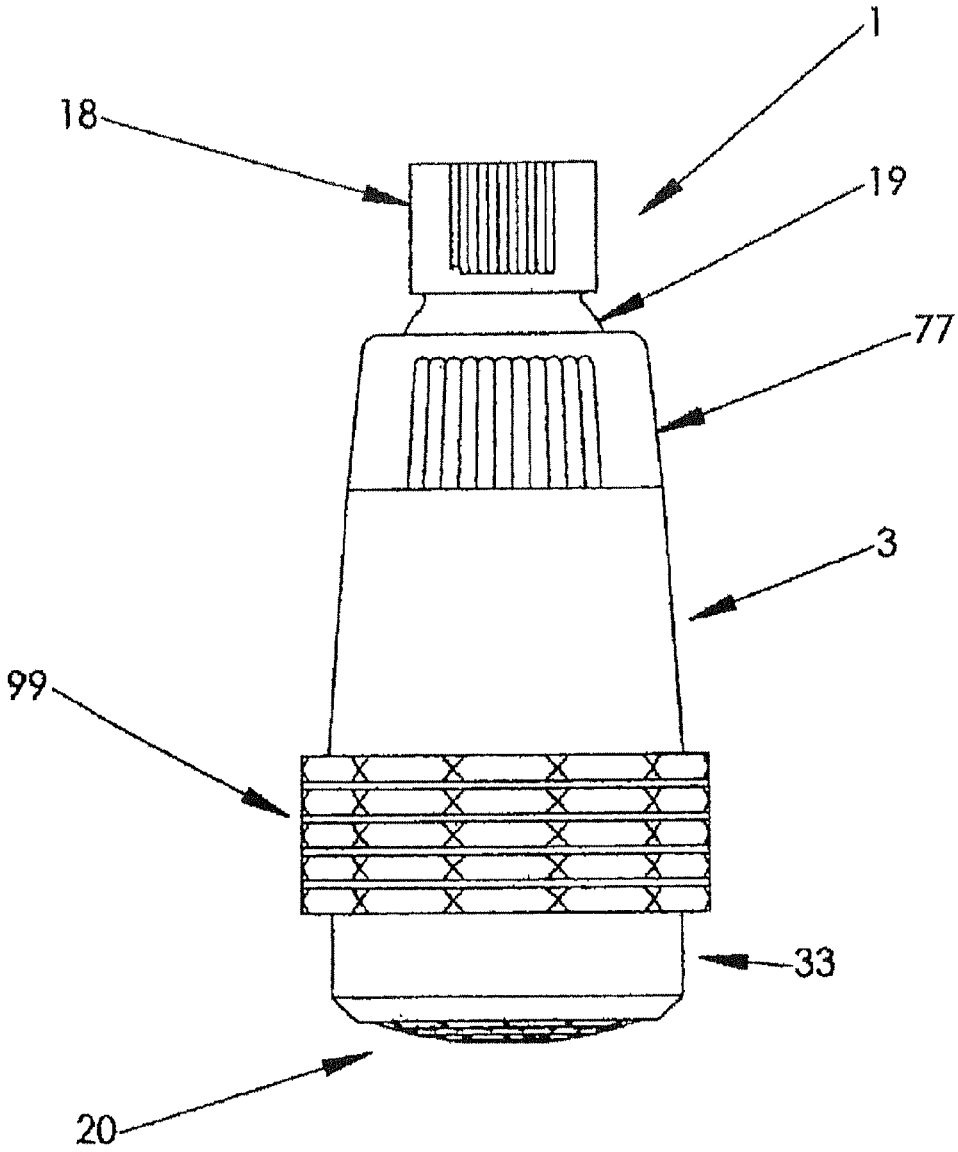
FIG. 1 is the lateral view of the water-saving shower head of this invention.
Figure 2:
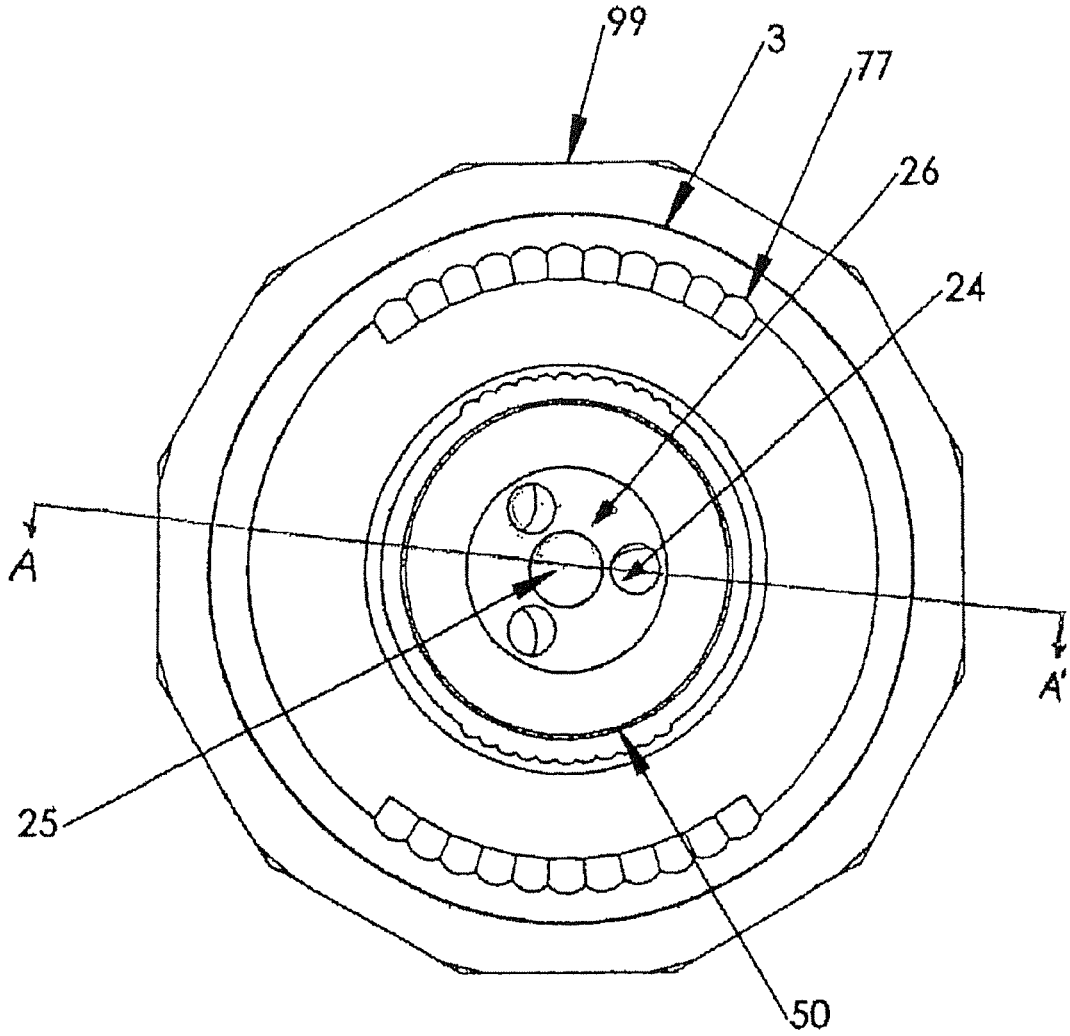
FIG. 2 is the upper view of the water-saving shower head of this invention.
Figure 3:
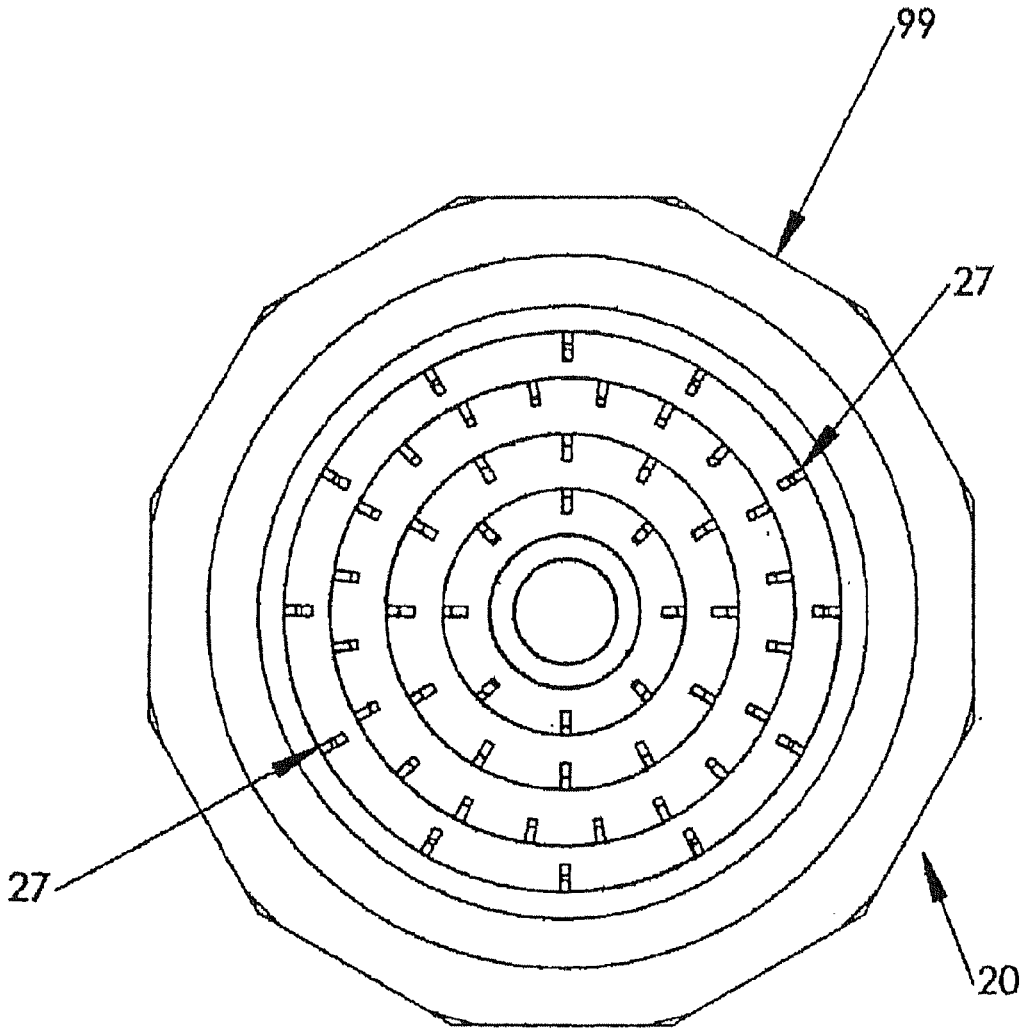
FIG. 3 is the lower view of the water-saving shower head of this invention.
Figure 4:
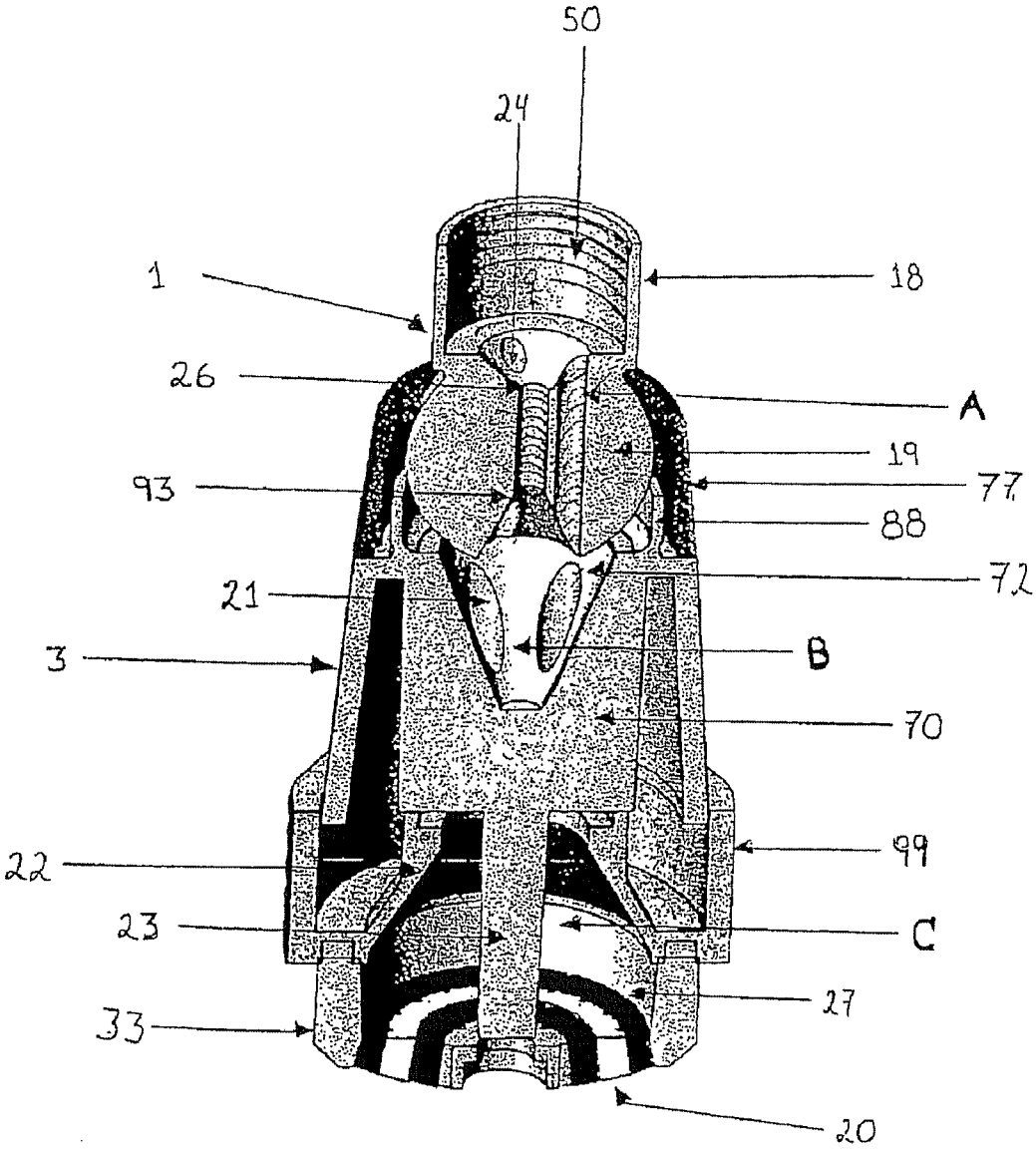
FIG. 4 is a transversal longitudinal cut view A-A' of the water-saving shower head, where the internal details of the water distribution chambers can be observed.
Figure 5:
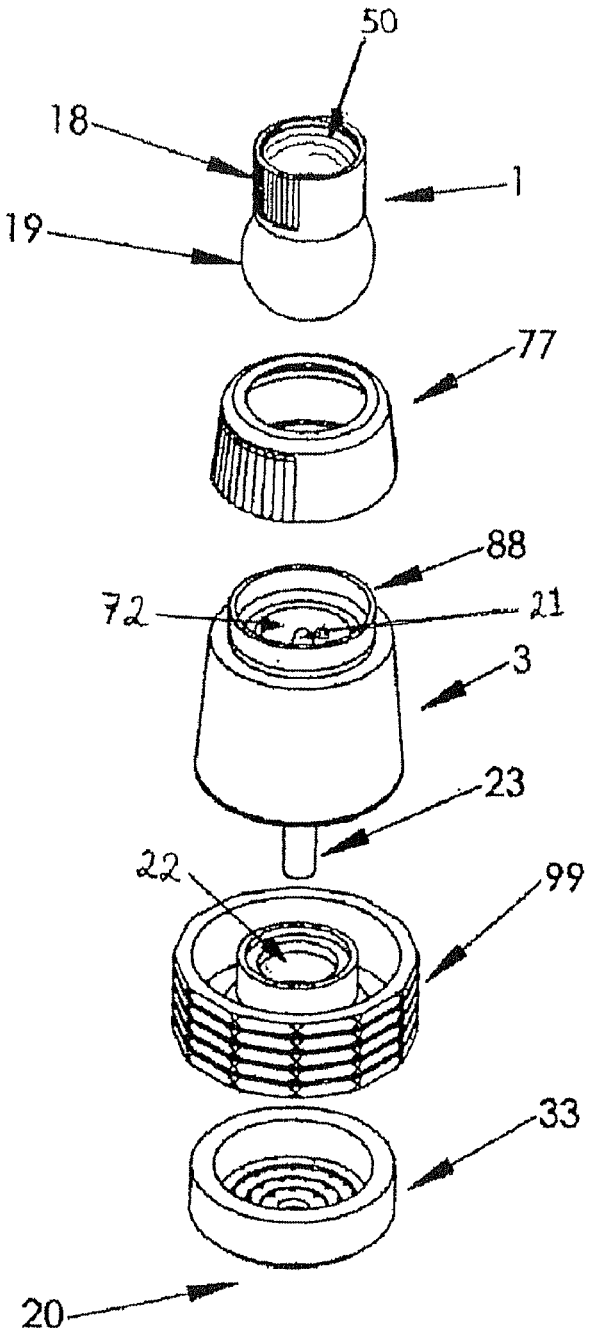
FIG. 5 is the individually sectioned perspective view of the water-saving shower head.
Figure 6:
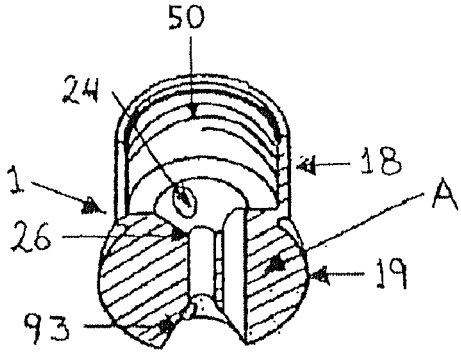
FIG. 6 is a longitudinal cut view of the socket joint, where the upper chamber can be observed.

The ball and socket joint 1, includes a tubular section 18, that contains and internal thread 50, where the pipes will adjust to. This section is connected to a solid sphere 19, that is different from the conventional ones, in this spheres interior contains a superior chamber A, in which itself contains a small funnel 26, that again different from the traditional ones (that only contain 1 exit conduit) this one contains 3 small longitudinal exit conduits 24, concentric, radial and equidistant, as well as the funnel exit 26, and the conduits 24, lead to conic cavity 93, as it is presented in FIG. 6. The superior chamber A serves to increase and distribute the water flow that comes from the pipe line.

The conoid body 3, in its interior contains an intermediate chamber B, in which is formed by a solid cylinder 70, with a superior conic cavity 72, with 4 longitudinal conduits 21, concentric, radial and equidistant, which run through the solid cylinder 70, from side to side. This chambers function is to increase the speed flow of the water in which is directed to the impulse system 20. Additionally, an axel 23, is found in the inferior part of the center of the solid cylinder, in order to unite it with the impulse system 20.

The interior conic surface 22, of the ring 99, composes the inferior chamber C, that receives the water flow for its way out through the impulse system 20.

Finally, The Impulse system 20, which is formed by flat smooth ring 33, that prolongs the inferior chamber C, which is used to support a series of four rings, different in diameter and slightly conically toothed and with a thickness between 5.1 and 5.7 mm. The form in which they are assembled is by introducing the slightly conical toothed rings from larger to smaller in size in the interior of the flat, smooth ring 33. This way 52 rectangular conducts are formed 27, circularly prepared and equidistant among each other, that impulse the way out of the water with the solidness and force, forming an adequate angle of diffusion to create a wetness area that provides a comfort during the shower. This system facilitates the cleanliness' of the conduits. This by only unscrewing and adjusting the toothed rings, an advantage that does not exist with the technical state of the shower heads.

The manner in which the elements are assembled, is to unite the ball and socket joint 1, with the conical body 3, by using a nut 77, that adjusts to the external thread 88, of such body 3, This body is assembled to the ring 99, which also assembles to impulse component with a screw that runs through the center of the impulse component that attaches to central axel 23.

This is the way one obtains a water-saving shower head that operates under low and high pressure, which water expense is considerably low in relation to the actual shower head technology previously mentioned. A fact that can be noticeably be seen in the following example.

EXAMPLE 1

With the purpose of supporting the efficiency of the present invention, a comparison was carried out with a conventional shower head, at different water pressures which results are shown in table 1.

TABLE 1

Efficiency of the water-saving shower head vs. the conventional one.

| | Waste L/H | | Time of usage of 10 L per Min. | |
|---|---|---|---|---|
| Pressure Kg/cm$^2$ | Normal shower head | Our shower head | Normal shower head | Our shower head |
| 0.40 | 500 | 160 | 1.20 | 3.59 |
| 0.50 | 700 | 300 | 1.10 | 2.40 |
| 0.70 | 900 | 400 | 0.46 | 2.19 |
| 1.00 | 1250 | 500 | 0.31 | 1.39 |

Another benefit of our shower head is because of the structure of the impulse system, through our toothed rings. This system facilitates the cleanliness' of the conduits. This by only unscrewing and adjusting the toothed rings, an advantage that does not exist with the technical state of the shower heads.

How the Water-Saving Shower Head Works

The shower head is installed by screwing in the internal thread 50, of the ball and socket joint 1, on to the external thread from the feeding water pipe until they are perfectly joined. Once this has been done, when the water has been opened, it will flow to the superior chamber A, which structure increases the flow until it reaches the intermediate chamber B, where again the flow is increased until it reaches the inferior chamber C, that also contributes by connecting directly with the water impulse system 20.

Now that our new invention has been described, in which we consider is a novelty, we claim these matters in the following clauses:

1. A water-saving shower head, comprising:

a connection member having a tubular portion adapted for connection to a water source, a spherical portion integral with the tubular portion, and a plurality of conduits passing through the spherical portion;

a body member coupled to the spherical portion of the connection member so as to form a ball and socket joint, the body member having a plurality of conduits passing therethrough;

a conical chamber disposed within the body member, the conical chamber being in fluid communication with the spherical portion and the plurality of conduits passing through the body member; and an impulse member coupled to the body member, the impulse member having a plurality of outlet conduits arranged in a selected pattern;

wherein the plurality of conduits passing through the spherical portion comprises:

a central funnel-shaped conduit; and at least one longitudinal conduit.

2. The water-saving shower head according to claim 1, further comprising:

a ring member coupled to the body member, the ring member having a conical interior surface.

3. The water-saving shower head according to claim 1, wherein the plurality of conduits passing through the body member comprise:

four longitudinal conduits equidistantly spaced within the body member.

4. The water-saving shower head according to claim 1, wherein each outlet conduit in the impulse member has a rectangular cross-sectional area.

5. The water-saving shower head according to claim 1, wherein the outlet conduits are arranged in four concentric circles.

6. The water-saving shower head according to claim 1, wherein the impulse member is coupled to the body member via an axel portion extending out from the body portion.

7. A water-saving shower head, comprising:

a connection member having a tubular portion adapted for connection to a water source, a spherical portion integral with the tubular portion, and a plurality of conduits passing through the spherical portion;

a body member coupled to the spherical portion of the connection member so as to form a ball and socket joint, the body member having a plurality of conduits passing therethrough;

a conical chamber disposed within the body member, the conical chamber being in fluid communication with the spherical portion and the plurality of conduits passing through the body member; and an impulse member coupled to the body member, the impulse member having a plurality of outlet conduits arranged in a selected pattern;

wherein the plurality of conduits passing through the spherical portion comprises:

a central funnel-shaped conduit; and three longitudinal conduits equidistantly spaced within the spherical portion.

* * * * *